US006299288B1

(12) United States Patent
Abeywardane et al.

(10) Patent No.: US 6,299,288 B1
(45) **Date of Patent: *Oct. 9, 2001**

(54) METHOD AND APPARATUS FOR VARIABLY CONTROLLING SIZE OF PRINT HEAD ORIFICE AND INK DROPLET

(75) Inventors: Mahindra F. Abeywardane, Long Beach; Ramesh B. Subbaraman, Fullerton; Barry R. Brucker, Beverly Hills, all of CA (US)

(73) Assignee: Independent Ink, Inc., Gardena, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/026,708

(22) Filed: Feb. 20, 1998

Related U.S. Application Data

(60) Provisional application No. 60/037,353, filed on Feb. 21, 1997.

(51) Int. Cl.[7] ..... B41J 2/14

(52) U.S. Cl. ..... 347/47; 347/68

(58) Field of Search ..... 347/68, 44, 47, 347/40, 73

(56) References Cited

U.S. PATENT DOCUMENTS

| | | | | |
|---|---|---|---|---|
| 3,871,004 | * | 3/1975 | Rittberg | 347/68 |
| 3,958,249 | | 5/1976 | DeMaine et al. | 347/75 |
| 4,395,719 | | 7/1983 | Majewski et al. | 347/68 |
| 4,513,299 | | 4/1985 | Lee et al. | 347/15 |
| 4,536,097 | | 8/1985 | Nilsson | 347/71 |
| 5,077,565 | | 12/1991 | Shibaike et al. | 347/15 |
| 5,124,716 | | 6/1992 | Roy et al. | 347/88 |
| 5,144,332 | | 9/1992 | Takayuri | 347/54 |
| 5,208,605 | | 5/1993 | Drake | 347/15 |
| 5,396,272 | | 3/1995 | Takahashi et al. | 347/47 |
| 5,430,470 | | 7/1995 | Stortz | 347/54 |
| 5,495,270 | | 2/1996 | Burr et al. | 347/10 |
| 5,812,163 | * | 9/1998 | Wong | 347/68 |
| 5,828,394 | * | 10/1998 | Khuri-Yakub et al. | 347/68 |
| 5,867,193 | * | 2/1999 | Yasuhara | 347/68 |
| 5,917,521 | * | 6/1999 | Haga et al. | 347/68 X |

FOREIGN PATENT DOCUMENTS

| | | | | |
|---|---|---|---|---|
| 58-59854 | * | 4/1983 | (JP) | 347/40 |

* cited by examiner

*Primary Examiner*—Benjamin R. Fuller
*Assistant Examiner*—C. Dickens
(74) *Attorney, Agent, or Firm*—Stradling Yocca Carlson & Rauth

(57) ABSTRACT

An ink jet print head apparatus which produces variably controls the ink jet print head orifices and the size of the ink jet droplets ejected therethrough, and a method for controlling the size of said orifices and ink jet droplets. The print head apparatus utilizes orifice plates formed from piezoelectric material selected according to expansion and contraction properties for the variable control of the diameter of the orifice through which the ink is ejected from the print head. The variability of the orifice dimensions is controlled by applying a voltage across the piezoelectric members, resulting in improved control over the size of the ejected ink droplets.

11 Claims, 5 Drawing Sheets

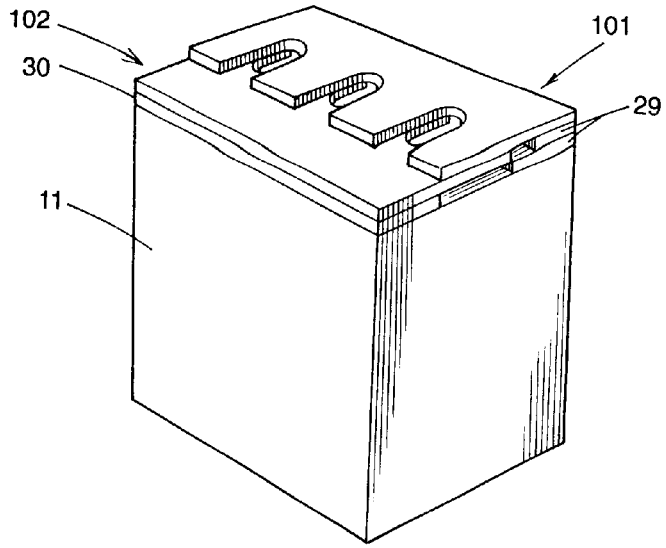
Fig. 2
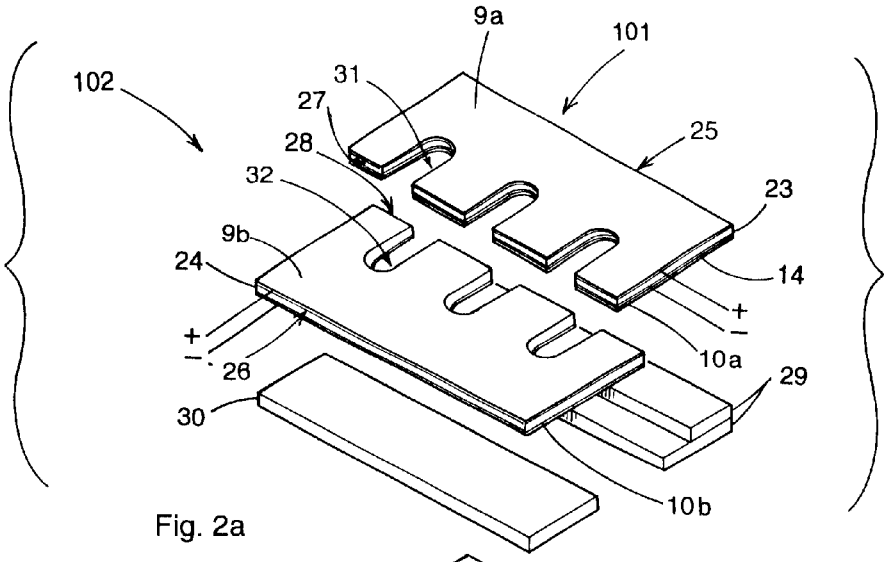
Fig. 2a
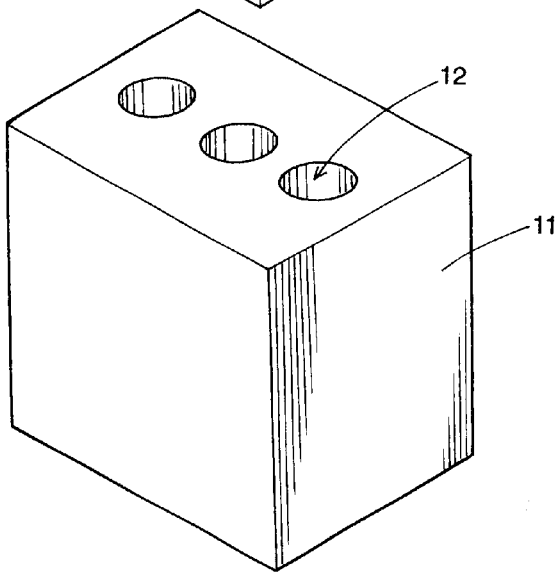

METHOD AND APPARATUS FOR VARIABLY CONTROLLING SIZE OF PRINT HEAD ORIFICE AND INK DROPLET

REFERENCE TO CO-PENDING PROVISIONAL APPLICATION

This Application claims the benefit of, and pursuant to 37 C.F.R. § 1.78(4) hereby makes express reference to, U.S. Provisional Application No. 60/037,353 filed on Feb. 21, 1997.

BACKGROUND OF THE INVENTION

1. Field of the Invention

The present invention relates to a drop on demand or continuous ink jet print head having an orifice plate the dimensions of which may be electronically controlled during the printing operation by piezoelectric displacement, thereby controlling the size of the ejected ink droplets.

2. Description of the Related Art

Ink jet printers are one of the most popular printer devices for personal or industrial use. Most ink jet printing systems may be classified as either a "continuous jet" type ink jet printing system or a "drop on demand" type ink jet printing system. In a continuous jet system, a continuous stream of ink is ejected from the print head, and broken into a series of discrete ink droplets, usually by a piezoelectric transducer. The ink droplets are directed either toward or away from the substrate on which the printed image is desired, according to the image data communicated to the printing system. The ink droplets that are directed away from the substrate are reclaimed and reintroduced into the continuous stream of ink.

In a drop on demand system, the print head contains one or more ink chambers filled with ink at or near atmospheric pressure. At this pressure, ink does not eject from the ink chambers even though each ink chamber contains an orifice sufficiently sized for the ejection of the ink. Each ink chamber is coupled to an electromechanical or electrothermal driver actuator that is used to create transient and localized increases in the pressure, according to the print image data. The increase of pressure accelerates the ink in the chamber which momentarily overcomes the threshold resistance needed to eject a droplet of ink through the orifice, thereby ejecting an ink droplet through the orifice. The pressure increases are generally created by a piezoelectric driver actuator or a "bubble jet" driver actuator. In the "bubble jet" system, an air bubble is formed adjacent to a heating element located at the surface of the ink chamber wall. The air bubble grows until it overcomes the surface tension of the chamber wall and displaces the surrounding ink until it overcomes the threshold resistance described above and is ejected through the orifice.

Generally speaking, the resolution of an ink jet printer is limited by the size of the ink droplets produced by the print head and the discrete positioning capability of the print head. The resolution may be increased by utilizing smaller orifices, but smaller orifice diameters result in slower print speeds. Since a printer for home, office or industrial use is normally asked to print high resolution at times and low resolution at other times, a single orifice diameter is insufficient. Several approaches and inventions therefore have been directed at producing a print head with arrays of orifices of more than one diameter.

A common approach to this problem involves software techniques known as half toning. Half toning methods direct the printer to overlay two or more ink droplets, either at a single print head position or at minute displacements from a single print head position. These approaches create different shades of ink impressions on the substrate, but utilize the single, fixed orifice diameter available in the attached print head. Therefore, half toning methods typically are slow and produce only marginal improvements over standard non-impact printing methods. Fixed orifice devices have also been designed to produce ink droplets of variable sizes by varying the driver actuator signals. See, U.S. Pat. No. 5,124,716 (to Roy, et al.), U.S. Pat. No. 4,513,299 (to Lee, et al.), and U.S. Pat. No. 5,495,270 (to Burr, et al.). To date, however, the variation in ink droplet sizes in such single-orifice-diameter systems is insufficient for the various tasks required of home, office, and industrial printers.

U.S. Pat. No. 5,208,605 to Drake discloses a dual array of orifices wherein one array has a higher resolution than the other to provide the capability of producing letter quality print. Drake therefore utilizes orifices of more than one diameter to provide both high-resolution print capabilities and speed when high-resolution is not required. One basic problem with Drake, however, is that the print head may become quite bulky and still can produce only two ink droplet sizes. Also, the configuration of Drake's print head appears to require additional translational movement of the print head when utilizing both orifice arrays in combination, thereby reducing the print speed and the accuracy of the positioning of the ink droplets.

An orifice plate containing four orifices of four different diameters is disclosed in U.S. Pat. No. 5,077,565 to Shibaike et al. For a given application, Shibaike positions the orifice of the desired diameter over the ink chamber by sliding the entire orifice plate via an electrostatic force. Shibaike discloses a complicated and costly manufacture process creating and array of "micro-machine" slider plates through lithography and etching on a semiconductor substrate.

U.S. Pat. No. 5,430,470 to Stortz discloses an ink jet system that replaces the electromechanical or electrothermal driver actuators with a constant high-pressure ink chamber system. Instead of employing driver actuators to drive the ink through the orifices, Stortz employs an array of piezoelectric shutters, opening same momentarily to allow an ink droplet to pass through, according to the print image data. The problems with the Stortz configuration are many, most of which stem from Stortz's attempt to design a high-pressure print head system. Instead of operating for the most part at atmospheric pressure, Stortz's disclosure operate under constant pressure. This requires a leak-proof seal at all times, except when the control signal voltage commands the piezoelectric shutter to open to allow the passage of ink, according to the print image data. Thus, a high-pressure system results in costly manufacture, power inefficiencies, and potential safety and leakage problems. Moreover, the Stortz system results in a limitation in controlling the exiting ink droplets producing unwanted tail features and satellite droplets that trail the intended ink droplet due to the shear forces present at the open shutter surfaces as the ink passes through under pressure.

SUMMARY OF THE INVENTION

The invention is directed to a print head apparatus including a control mechanism which permits controlled variation of the size of the print orifices to deliver variably sized ink droplets to substrate surfaces. The invention is further directed to a method of variably controlling the size of such orifices and resulting ink droplets to effect a higher image resolution and gray scale quality. This method and print head apparatus incorporate dynamic orifice plates utilizing piezoelectric properties. This methodology is superior to existing ink droplet variation technologies because of its uncomplicated design and operation. This method of dynamic orifice control can produce a greater droplet size variation in comparison to existing technologies. Fewer orifices of this invention are needed to produce droplets of variable sizes allowing for the print head to be smaller and simpler in design than other technologies that have attempted to address the problem. The ease of adaptability of this invention to current conventional print head systems is another important aspect of the present invention.

BRIEF DESCRIPTION OF THE DRAWINGS

These and other objects and features of the present invention will become apparent from the following description taken in conjunction with the accompanying drawings, in which:

FIG. 2 is a perspective view of a second embodiment involving overlapping orifice plate segment assemblies and print head manifold, according to the present invention.

FIG. 2*a* is a detailed exploded isometric view of the print head manifold and orifice plate segment assemblies shown in FIG. 2.

DETAILED DESCRIPTIONS OF THE PREFERRED EMBODIMENTS

Figure 1A:
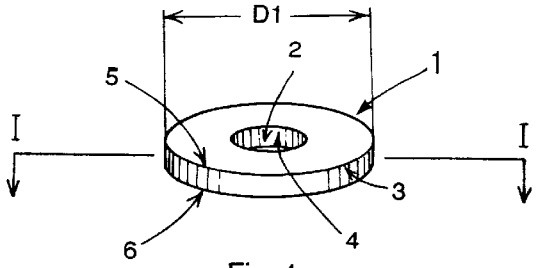
FIG. 1*a* is an isometric view of a disk-shaped orifice plate member according to the present invention.

The first embodiment of the present invention, shown in FIG. 1*a,* involves orifice plate members 1 cut from thin sheets of piezoelectric material by an eximer laser. As shown in FIG. 1*a,* disk-shaped orifice plate members are a preferred embodiment having a diameter of D1 defined by the outer surface 3, and thickness T1 defined by the generally planar top and bottom surfaces, 5 and 6, respectively, of said orifice plate 1.

An eximer laser is also used to drill or ablate through each orifice plate 1 forming an approximately circular orifice 2, having a diameter D2 defined by the inner surface 4 of the orifice plate member 1. This embodiment relies on the expansion/contraction properties of the piezoelectric material comprising orifice plate 1 for controlling the dimensions of the orifice plate 1 and the corresponding diameter of the orifice 2 therethrough during use.

Figure 1B:
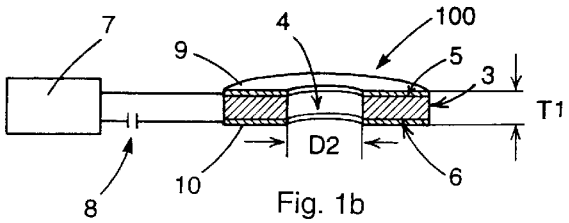
FIG. 1*b* is a sectional view of an orifice plate assembly having a disk-shaped orifice plate member taken along the line I—I in FIG. 1*a*.

FIG. 1*b* illustrates an orifice plate assembly 100 having control mechanism 7, power source 8, and electrodes 9 and 10. Electrodes 9 and 10 are assembled and electroplated to the top and bottom surfaces 5 and 6, respectively, of orifice plate 1, as shown. Electrodes 9 and 10 are capable of conducting current from said power source 8 directed through control mechanism 7. It is contemplated that control mechanism 7 will normally comprise a printer or a computer driving said printer. During use, variations in voltage may be applied across orifice plate 1 through electrodes 9 and 10, according to print image data interpreted by control mechanism 7.

Figure 1C:
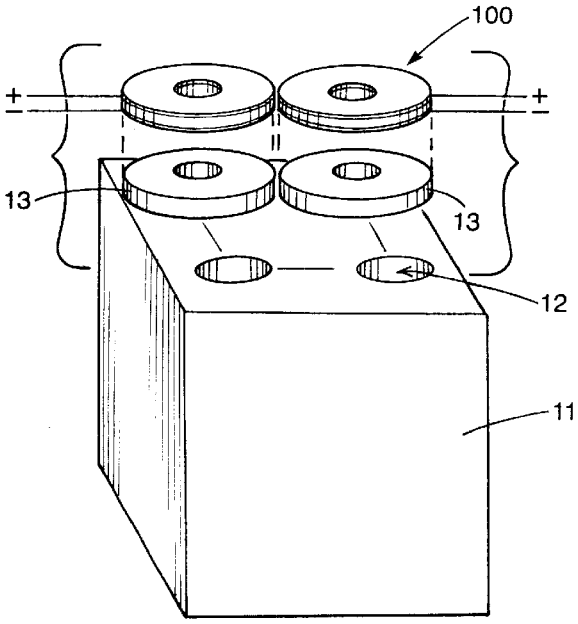
FIG. 1*c* is an exploded isometric view of the disk-shaped orifice plate member as it is positioned in relation to the capillary openings of a print head manifold that contains a square array of said capillary openings.
Figure 1D:
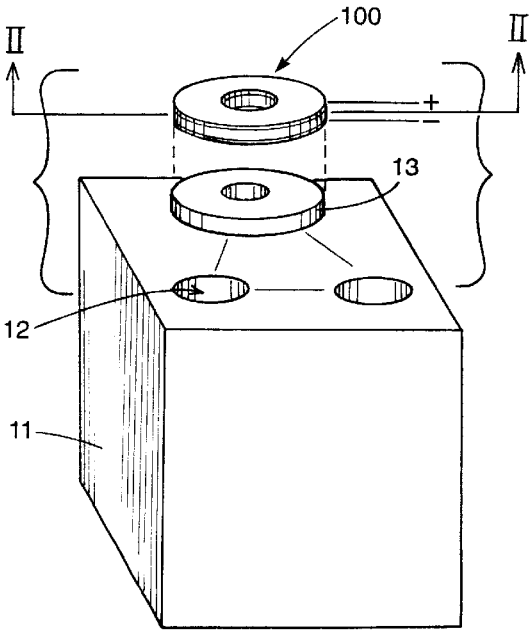
FIG. 1*d* is an exploded isometric view of the disk-shaped orifice plate member as it is positioned in relation to the capillary openings of a print head manifold that contains a triangular array of said capillary openings.

FIGS. 1*c* and 1*d* illustrate orifice plate assemblies 100 mounted on print head manifolds 11. Each orifice plate assembly 100 is coupled to a capillary opening 12 on the top surface of said print head manifold 11. The capillary openings 12 are the exit ports through which ink from an ink chamber exits the print head manifold 11 and thereby comes into communication with the orifice plate assembly 100. The orifice plate assembly 100 is affixed to the print head manifold 11 by various means including without limitation, soldering of the orifice plate assembly 100 to the print head manifold 11 using multiple-microchip layering technology. This is a well known method used to solder together multiple layers of print head and orifice plate material. In the embodiment shown, a series of such orifice plates are coupled with capillary openings 12 of print head manifold 11 in an array arrangement which may be squarely or rectangularly pitched, as shown in FIG. 1*c,* or triangularly pitched, as shown in FIG. 1*d.*

Figure 1E:
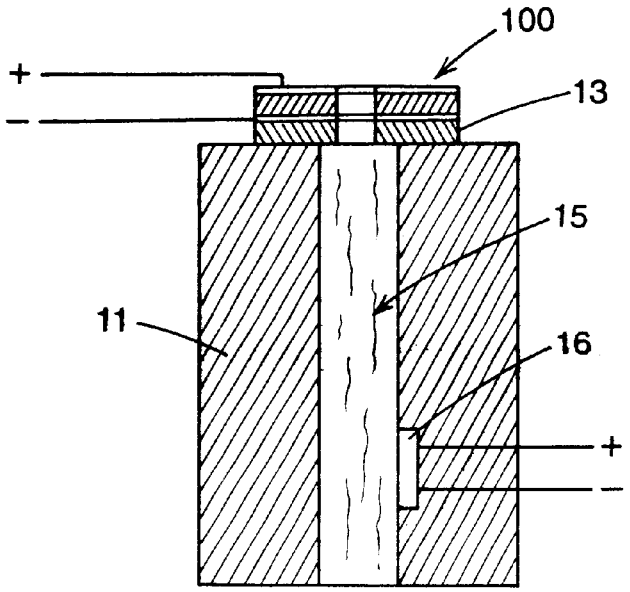
FIG. 1*e* is a sectional view of an orifice plate assembly as shown in FIG. 1*b* mounted in common with the print head manifold taken along the line II—II in FIG. 1*d* and connected to the control circuit according to the present invention.

The embodiment shown in FIG. 1*e* is a sectional view of the orifice plate assembly 100 mounted on the print head manifold 11. The stationary placement of a polymeric insulator 13 between the orifice plate assembly 100 and the print head manifold 11 provides a closed circuit and insulation. The capillary channel 15 works as the ink carrying channel through the print head manifold 11 from the ink reservoir (not shown). An ejection driver 16, either a thermal resistor or a piezoelectric driver actuator, is in hydraulic communication with capillary channel 15.

The orientation of piezolelectric crystals in the orifice plate 1 are selected so that orifice plate diameter D1 and orifice diameter D2 are variably increasable (by expansion of the orifice plate dimensions) or decreasable (by contraction of the orifice plate dimensions) via piezolelectric displacement upon controlled application of voltage through electrodes 9 and 10. The precise dimensions of diameters D1 and D2 and orifice plate thickness T1 are selected and calibrated according to the selected piezoelectric material's electronic charge constant C1, the ambient temperature at which the print head will be maintained and the desired displacement of the crystals of the orifice plate upon application of voltage thereto. Accordingly, the orifice diameter D2 is variably controllable depending on the voltage applied at electrodes 9 and 10.

Thus, for example, one preferred embodiment of the present invention involves a disk-shaped orifice plate 1 having a diameter D1 of 3515 micrometers, an orifice diameter D2 of 15 micrometers, a thickness T1 of 130 micrometers, and a charge constant C1 of 274×10 to the−12th power m/V (for lead zirconate titanate, a commercially available piezoelectric material). Upon application of 50 volts while maintaining the orifice plate 1 below the curie temperature, a total reduction in the orifice diameter D2 is approximately 0.32 micrometers. Further controlled application of variations of the voltage (i.e., 0 volts, 50 volts, 100 volts, etc., or any voltage therebetween) results in corresponding variations in the orifice diameter D2.

Figure 1F:
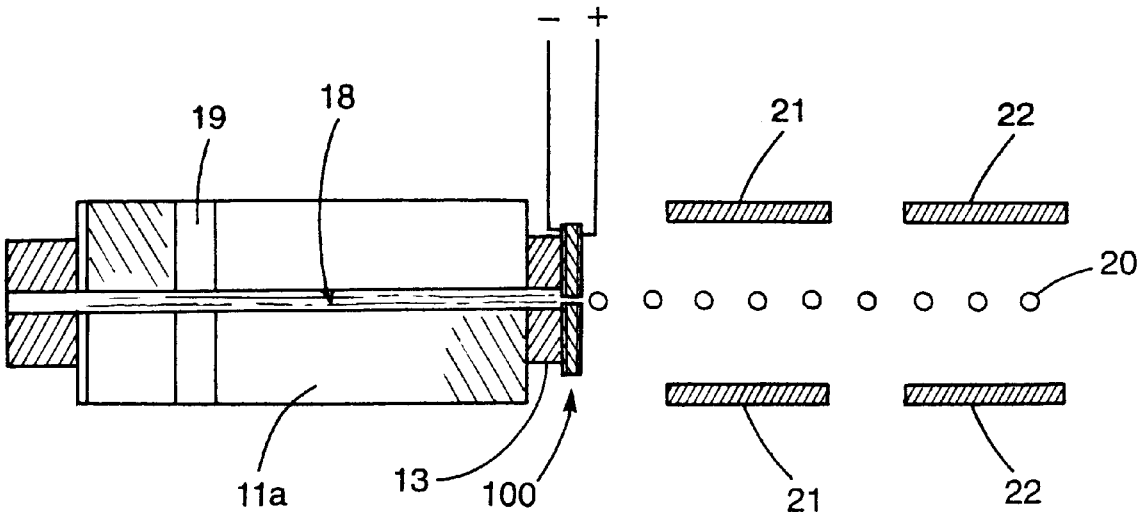
FIG. 1*f* is a sectional view of an orifice plate assembly as shown in FIG. 1*b* mounted in common with a continuous ink jet print head manifold according to the present invention.

It is also contemplated that the present invention is adaptable to a continuous ink jet system. The embodiment shown in FIG. 1*f* involves orifice plate assembly 100 mounted to a continuous ink jet print head manifold 11*a*. A conventional continuous ink jet system produces a steady stream 18 of ink through a piezoelectric transducer 19. The vibration of the transducer results in the formation of uniform droplets. This embodiment of the present invention incorporates an orifice plate assembly 100, as described in connection with FIG. 1*b*, to front surface of the continuous ink jet print head manifold 11*a* to control the diameter of the exiting ink droplets 20. This method and device results in converting the uniform droplets in conventional continuous ink jet stream to variably sized ink droplets 20. As with conventional continuous ink jet printer systems, the ejected ink droplets are charged electrically by charge plates 21 and then deflected by deflection plates 22 toward or away from a print substrate (not shown) to produce the desired image on the substrate.

Figure 2B:
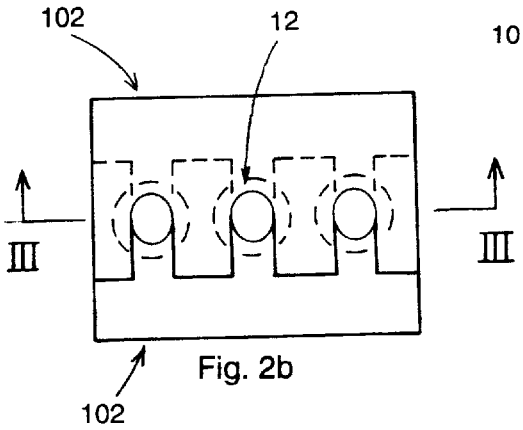
FIG. 2*b* is a top plan view of the orifice plate segment assemblies of FIG. 2*a* when no voltage is applied to the orifice plate segment assemblies.
Figure 2D:
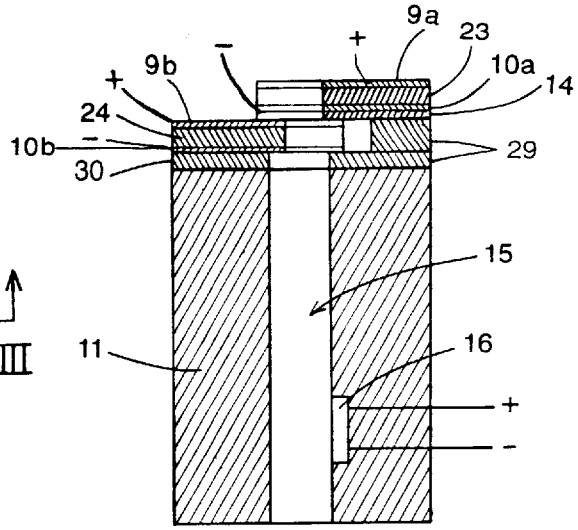
FIG. 2*d* is a sectional view of the orifice plate segment assemblies and print head manifold of FIG. 2*a* taken along the line III—III in FIG. 2*b* when no voltage is applied to the orifice plate segment assemblies.
Figure 2C:
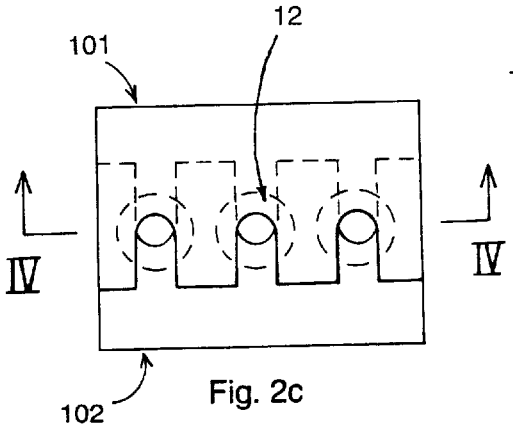
FIG. 2*c* is a top plan view of the orifice plate segment assemblies of FIG. 2*a* when a voltage is applied to the orifice plate segment assemblies.
Figure 2E:
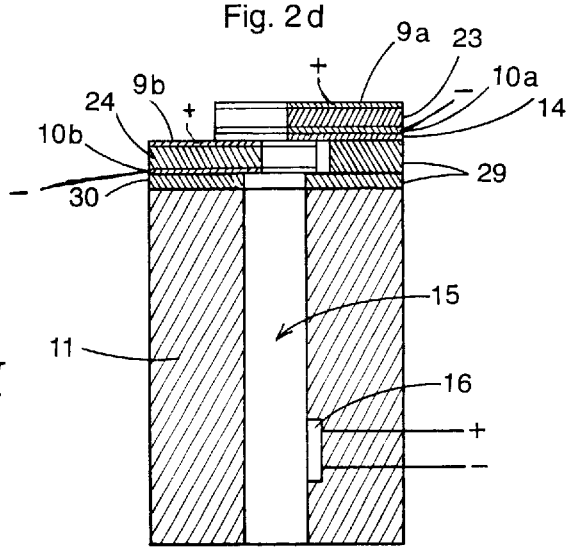
FIG. 2*e* is a sectional view of the orifice plate segment assemblies and print head manifold of FIG. 2*a* taken along the line IV—IV in FIG. 2*c* when a voltage is applied to the orifice plate segment assemblies.
Figure 2F:
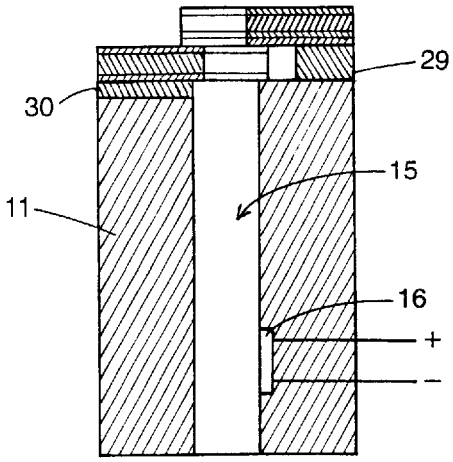
FIG. 2*f* is a sectional view of overlapping orifice plate segment assemblies similar to FIG. 2, except that the print head manifold in FIG. 2*e* is stepped to account for the overlap of the orifice plate segment assemblies.

FIGS. 2 through 2*f* show another embodiment of the present invention. In this embodiment, the orifice plate is formed from two overlapping orifice plate segment assemblies 101 and 102. FIG. 2*a* shows an exploded three dimensional view of the preferred embodiment of this multi-layer orifice plate assembly. As shown in FIG. 2*a*, orifice plate segment assembly 101 has a piezoelectric segment 23 formed of piezoelectric material, electrical contacts 9*a* and 10*a* in electrical communication with the top surface and bottom surface, respectively, of piezoelectric segment 23, a power supply and control mechanism (not shown), as previously described in relation to the prior embodiments to control the voltage applied across the piezoelectric segment 23 through electrical contacts 9*a* and 10*a*. Orifice plate segment assembly 102 has a piezoelectric segment 24 formed of piezoelectric material, electrical contacts 9*b* and 10*b* in electrical communication with the top surface and bottom surface, respectively, of piezoelectric segment 24, a power supply and control mechanism (not shown), as previously described in relation to the prior embodiments to control the voltage applied across the piezoelectric segment 24 through electrical contacts 9*b* and 10*b*. A polymeric insulator 14 is fixed to the bottom surface of electrical contact 10*a* to provide insulation for a closed circuit within orifice plate segment assembly 101.

As shown in FIGS. 2 through 2*e*, orifice plate segments assemblies 101 and 102 partially overlap forming an array of orifices. Orifice plate segment assemblies 101 and 102 have front surfaces 27 and 28, respectively, and back surfaces 25 and 26, respectively. Said back surfaces 25 and 26 are mounted and fixed to print head manifold 11 at the edges of said back surfaces of the orifice plate segment assemblies or to a support frame (not shown) common to both print head manifold 11 and said orifice plate segment assemblies. The other surfaces of 101 and 102 are free to move and change configuration according to the piezoelectric deflection forced upon them. It should be noted that the print head manifold 11 as shown in FIGS. 2 and 2*a* is representative of an array of channels, only three such channels of which are shown for ease of illustration. It is contemplated that the present invention may comprise any number of channels in such an array.

Polymeric insulator 29 is placed between the orifice plate segment assembly 101 and the print head manifold 11 to insulate the print head manifold 11 from the current which passes through the orifice plate segment assembly 101 during use. Similarly, the polymeric insulator 30 is placed between the orifice plate segment assembly 102 and the print head manifold 11 to insulate the print head manifold 11 from the current which passes through the orifice plate segment assembly 102 during use. The thickness of polymeric insulator 29 is made approximately the sum of the thicknesses of polymeric insulator 30 and orifice plate segment assembly 102 combined. As a consequence, when orifice plate segment assembly 101 is mounted in communication with polymeric insulator 29 and orifice plate segment assembly 102 is mounted in communication with polymeric insulator 30, the orifice plate segment assemblies 101 and 102 are staggered and overlap, as described below. FIGS. 2 through 2*e* show polymeric insulator 29 as two layers due to considerations of ease of manufacture, but it is contemplated that polymeric insulator 29 could be machined from a single strip of polymeric material.

The orifice plate segment assemblies 101 and 102 overlap, such that a portion of the bottom surface of orifice plate segment assembly 101 lies in communication with the top surface of orifice plate segment assembly 102. Arranged along the front surfaces 27 and 28 of said orifice plate segment assemblies are a series of grooves, represented by grooves 31 and 32, respectively, which overlap to form an array of orifices. The dimensions of the orifice plate segment assemblies 101 and 102 may be varied by controlling the voltages applied to top and bottom surfaces of said assemblies through the electrodes 9*a*, 10*a*, 9*b*, and 10*b*. As the dimensions of the orifice plate segment assemblies change, they slide with respect to each other, thereby varying the diameter of the orifices formed by the paired grooves 31 and 32 in said orifice plate segment assemblies.

FIG. 2*b* provides a top plan view of the orifice plate segment assemblies 101 and 102 when mounted to print head manifold 11 and additionally represents the capillary openings 12 by dashed circles to demonstrate the manner in which the paired grooves 31 and 32 lie above said capillary openings. The orifice plate segment assemblies 101 and 102, as shown in FIG. 2*b*, represent the dimensions of the array of orifices formed when no voltage is applied to the orifice plate segment assemblies 101 and 102. FIG. 2*c* shows an alternate dimension of the orifice plate segment assemblies and corresponding alternate dimensions of the array of orifices formed when a voltage is applied across the orifice plate segment assemblies 101 and 102. FIG. 2*b* corresponds to the dimensions of the orifice plate segment assemblies 101 and 102 when no voltage is applied, whereas FIG. 2*c* corresponds to the dimensions of the orifice plate segments when a measurable voltage is applied to the orifice plate segment assemblies 101 and 102. FIGS. 2*d* and 2*e* are cross sectional views of the overlapping orifice plate assembly corresponding to the two alternate dimensions shown in FIGS. 2*b* and 2*c,* respectively.

The orifice plate segment assemblies 101 and 102 overlap, such that a portion of the bottom surface of orifice plate segment assembly 101 lies in communication with the top surface of orifice plate segment assembly 102. Arranged along the front surfaces 27 and 28 of said orifice plate segment assemblies are a series of grooves, represented by grooves 31 and 32, respectively, which overlap to form an array of orifices. The dimensions of the orifice plate segment assemblies 101 and 102 may be varied by controlling the voltages applied to top and bottom surfaces of said assemblies through the electrodes 9*a,* 10*a,* 9*b,* and 10*b.* As the dimensions of the orifice plate segment assemblies change, they slide with respect to each other, thereby varying the diameter of the orifices formed by the paired grooves 31 and 32 in said orifice plate segment assemblies.

As an example, this preferred embodiment contemplates a nominal orifice diameter of approximately 10 or 15 micrometers and a maximum voltage of 50 volts, which may be varied essentially continuously between zero and said maximum voltage. The material contemplated for orifice plate segments may be any one of a number of piezoelectric materials selected for its properties, including its charge constant C1 (the charge constant C1 for lead zirconate titanate, a commercially available piezoelectric material, is 274×10 to the −12th power m/V). Where the thickness T2 of the respective orifice plate segments is 130 micrometers, the combined maximum displacement of both of the orifice plate segments in this example would be approximately 0.334 micrometers. This maximum displacement corresponds to an operable reduction in orifice size of 33.4% from a nominal orifice diameter of 10 micrometers or 22.3% from a nominal orifice diameter of 15 micrometers. This wide variability in dimension is a significant improvement over any other device directed at this problem. The controlled application of voltages between 0 volts and 50 volts results in corresponding variable orifice diameters.

FIG. 2*f* is a sectional view of the overlapping orifice plate device, except that the top surface of the print head manifold 11 in FIG. 2*f* is stepped to provide for the stepped effect of the overlapping orifice plate segment assemblies 101 and 102. In this embodiment, the polymeric insulators 29 and 30 may by of approximately equal thickness.

Figure 3:
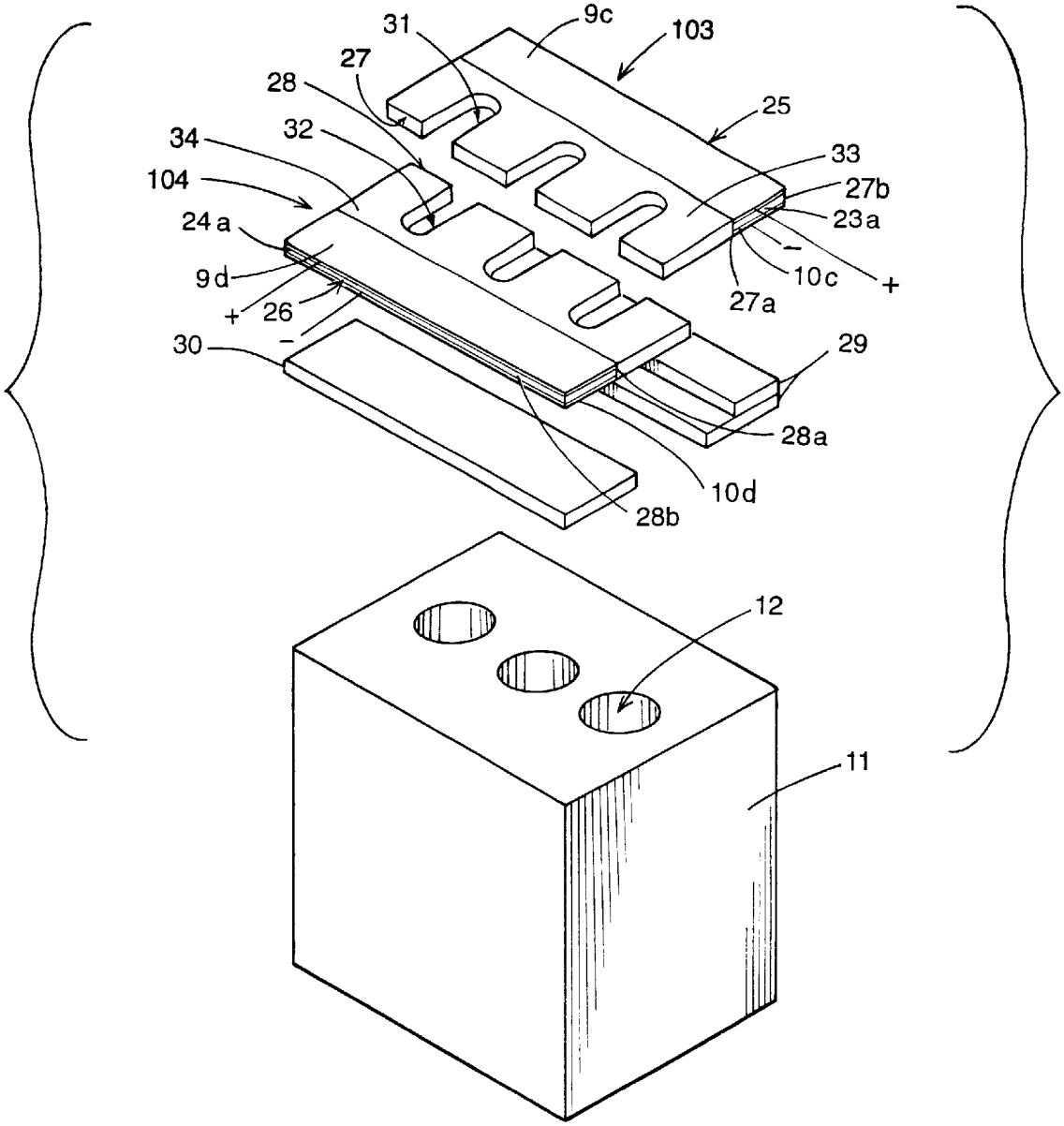
FIG. 3 is an isometric view of a third embodiment involving overlapping orifice plate segment assemblies and print head manifold according to the present invention, wherein the orifice plate segment assemblies are composed of both a piezoelectric material and a polymeric material.

FIG. 3 shows another embodiment of the overlapping orifice plate device. As shown in FIG. 3, orifice plate segment assembly 103 has a piezoelectric actuator segment 23*a* formed of piezoelectric material, a polymeric load segment 33, electrical contacts 9*c* and 10*c* in electrical communication with the top surface and bottom surface, respectively, of piezoelectric actuator segment 23*a,* a power supply and control mechanism (not shown), as previously described in relation to the prior embodiments to control the voltage applied across the piezoelectric actuator segment 23*a* through electrical contacts 9*c* and 10*c.* Orifice plate segment assembly 104 has a piezoelectric actuator segment 24*a* formed of piezoelectric material, a polymeric load segment 34, electrical contacts 9*d* and 10*d* in electrical communication with the top surface and bottom surface, respectively, of piezoelectric segment 24*a,* a power supply and control mechanism (not shown), as previously described in relation to the prior embodiments to control the voltage applied across the piezoelectric segment 24*a* through electrical contacts 9*d* and 10*d.*

Piezoelectric actuator segments 23*a* and 24*a* have front surfaces 27*a* and 28*a,* respectively. The polymeric load segments 33 and 34 have back surfaces 27*b* and 28*b,* respectively. Said back surface 27*b* of polymeric load segment 33 is fixed to said front surface 27*a* of piezoelectric actuator segment 23*a,* and said back surface 28*b* of polymeric load segment 34 is fixed to said front surface 28*a* of piezoelectric actuator segment 24*a.*

Thus configured, orifice plate segment assemblies 103 and 104 have front surfaces 27 and 28, respectively, and back surfaces 25 and 26, respectively. Said back surfaces 25 and 26 are mounted and fixed to print head manifold 11 at the edges of said back surfaces of the orifice plate segment assemblies or to a support frame (not shown) common to both print head manifold 11 and said orifice plate segments.

The orifice plate segment assemblies 103 and 104 overlap in the manner described of orifice plate segment assemblies 101 and 102, such that a portion of the bottom surface of orifice plate segment assembly 103 lies in communication with the top surface of orifice plate segment assembly 104. Arranged along the front surfaces 27*a* and 28*a* of said orifice plate segment assemblies are a series of grooves, represented by grooves 31 and 32, respectively, which overlap to form an array of orifices. The dimensions of the orifice plate segment assemblies 103 and 104 may be varied by controlling the voltages applied to top and bottom surfaces of said assemblies through the electrodes 9*c,* 10*c,* 9*d,* and 10*d.* As the dimensions of the orifice plate segment assemblies change, they slide with respect to each other, thereby varying the diameter of the orifices formed by the paired grooves 31 and 32 in said orifice plate segment assemblies.

The induction of voltage to the driver actuators 23*a* and 24*a* cause the orifice plate members to move in relative opposing displacements thereby varying the diameter of the orifices created by the alignment of grooves in said front surfaces 27*a* and 28*a.*

In use, the orifices 2 shown in FIGS. 1*a* through 1*f* and the orifices in the embodiments shown in FIGS. 2 through 3, created by the overlapping grooves 31 and 32, always provide an opening to the ambient such that the ink is constantly communicated to the ambient. The degree of the opening is varied by the application of various voltages so that the size and configuration of the ink droplet may be controlled much greater than in the prior art.

It has been found that the arrangements in the present invention is superior over the prior art in that the present invention requires only low pressure actuation to drive ink droplets of a predictable size thereby eliminating splatter, undesired satellite droplets and fluid ligament contamination of the substrate. This arrangement eliminates the danger of a high-pressure system and costly manufacture, realizes efficiencies of operation, and minimizes the dangers of leaking. With this arrangement, a wide variety of droplet sizes and forms may be achieved without the costly and inefficient operation associated with using multiple orifices of varying sizes.

According to the present invention, an orifice of fixed diameter at manufacture is simply varied through voltage manipulation of a piezoelectric material which constantly communicates a source of ink generally at ambient pressure to the atmosphere except during operation as previously described.

What is claimed is:

1. An ink jet print head apparatus comprising:

a print head manifold having a top surface, said top surface containing at least one ink capillary opening for the delivery of ink to a substrate;

an orifice plate member formed of a piezoelectric material, said orifice plate member having an orifice formed therethrough;

a voltage control mechanism in electronic communication with said orifice plate member for controlling the dimensions of said orifice through piezoelectric displacement; and wherein said orifice plate member is disposed with respect to the top surface of said print head manifold such that the orifice is in communication with said ink capillary opening in said print head manifold, and wherein the application of voltage to said orifice plate member causes the dimensions of said orifice to decrease and wherein said orifice plate member is configured such that the orifice thereof is always open.

2. An apparatus for controlling ink droplet formation comprising:

a source of ink maintained generally at ambient pressure;

an orifice plate member formed of a piezoelectric material having an aperture therethrough, the orifice plate member being formed such that the aperture is always open;

an ink actuator; and a voltage control mechanism in electronic communication with said orifice plate member to vary the size of the aperture such that droplets of a controlled size may be controllably admitted through said aperture.

3. The apparatus of claim 2 including:

means for electrically charging said droplets of ink.

4. The apparatus of claim 3 further including:

means for controlling the direction of travel of said ink droplets.

5. The apparatus of claim 2 including:

means for deflecting the direction of travel of said ink droplets.

6. A method for producing ink images on a substrate, the method comprising:

providing a source of ink generally at ambient pressure;

providing a piezoelectric material having an aperture therethrough, the piezoelectric material being formed such that the aperture is always open:

varying the pressure at which said ink is stored so as to drive controlled amounts of said ink through said aperture; and applying a voltage across said piezoelectric material so as to vary the dimensions of said aperture so as to produce ink droplets of a desired form at the appropriate time.

7. The method of claim 6 wherein applying voltage across said piezoelectric material causes the dimensions of said aperture to decrease.

8. A drop-on-demand ink jet print head apparatus that operates at near atmospheric pressure comprising:

a print head manifold having a top surface, said top surface containing at least one ink capillary for the delivery of ink to a substrate;

a first plate member formed of a piezoelectric material connected to said top surface of the print head manifold and covering said ink capillary, said first plate member having at least one groove;

a second plate member formed of a piezoelectric material connected to said top surface of the print head manifold and covering said ink capillary, said second plate member having at least one groove;

wherein said grooves of said first plate member and said second plate member are configured so as to form at least one always open orifice;

wherein said orifice is in fluid communication with said ink capillary;

an ink actuator for varying the pressure of the ink so as to cause portions thereof to flow through said orifice;

a voltage control mechanism in electronic communication with said first plate member for controlling the dimensions of said first plate member and said groove through piezoelectric displacement; and a voltage control mechanism in electronic communication with said second plate member for controlling the dimensions of said second plate member and said groove through piezoelectric displacement.

9. The apparatus of claim 8 wherein said voltage control mechanism comprises a printer.

10. The apparatus of claim 8 wherein said voltage control mechanism comprises a computer controlling a printer.

11. The apparatus of claim 8 wherein ink actuator varies the pressure of the ink so as to cause portions thereof to flow through said orifice.

* * * * *